US005581329A

United States Patent [19]

Kosmider et al.

[11] Patent Number: 5,581,329

[45] Date of Patent: Dec. 3, 1996

[54] CONTACT CHARGER

[75] Inventors: Ronald T. Kosmider, Fairport, N.Y.; Thomas P. DiPasquale, Phoenixville, Pa.

[73] Assignee: Imaging Rechargers Inc., Fairport, N.Y.

[21] Appl. No.: 539,400

[22] Filed: Oct. 5, 1995

[51] Int. Cl.[6] ..... G03G 15/02

[52] U.S. Cl. ..... 355/219; 492/56; 361/225

[58] Field of Search ..... 355/219, 271–273; 492/53, 56; 361/221, 225

[56] References Cited

U.S. PATENT DOCUMENTS

| | | | |
|---|---|---|---|
| 4,309,737 | 1/1982 | Tolmie, Jr. . | |
| 4,727,453 | 2/1988 | Ewing . | |
| 4,935,778 | 6/1990 | Mochida . | |
| 5,017,965 | 5/1991 | Hashimoto et al. . | |
| 5,126,913 | 6/1992 | Araya et al. . | |
| 5,235,386 | 8/1993 | Yano et al. . | |
| 5,241,343 | 8/1993 | Nishio . | |
| 5,270,768 | 12/1993 | Murata . | |
| 5,307,122 | 4/1994 | Ohno et al. | 355/219 X |
| 5,313,359 | 5/1994 | Imagawa et al. . | |
| 5,367,364 | 11/1994 | Michlin et al. . | |
| 5,402,213 | 3/1995 | Ikegawa et al. . | |
| 5,412,455 | 5/1995 | Ono et al. | 355/219 |
| 5,414,492 | 5/1995 | Kubota | 355/200 |
| 5,443,873 | 8/1995 | Itani et al. . | |
| 5,447,813 | 9/1995 | Hagiwara et al. | 430/106.6 |
| 5,447,815 | 9/1995 | Kato et al. | 430/110 |
| 5,465,136 | 11/1995 | Watanabe | 355/219 X |
| 5,475,467 | 12/1995 | Watanabe et al. | 355/200 |

OTHER PUBLICATIONS

11th Annual Toner & Photoreceptor Conference & Trade Fair, Imaging Materials Seminar, Roller Charging in Electrophotographic Imaging Devices, Dr. John Wyhof, Santa Barbara, CA, Jun. 5–8, 1994.

Roller Charging Technology.

Charging Rollers by Lester Cornelius.

IIISi/4Si Primary Charge Rollers, Three Layer Design is the Only Real Solution, Static Control Components, Inc. Copyright Nov. 1994.

*Primary Examiner*—R. L. Moses

*Attorney, Agent, or Firm*—Cumpston & Shaw

[57] ABSTRACT

A contact charger for charging an outer surface of an electrostatic latent image carrier in contact therewith wherein the charging member includes a co-cured polychloroprene and ECO mixture electrically connected to a conductive substrate. The cured homogeneous mixture is covered with an adhesion resistant layer.

24 Claims, 3 Drawing Sheets

CONTACT CHARGER

FIELD OF THE INVENTION

The present invention relates to a charging member contactable to a member to be charged such as an image bearing member in an electrophotographic device, and more particularly, to a contact charger which charges another member by bringing the charger into contact with a surface of the member to be charged and applying a voltage to the charger.

BACKGROUND OF THE INVENTION

For purposes of explanation, the present description is made in the example of an image forming apparatus such as an electrophotographic apparatus. In a conventional charging step in an electrophotographic process using an electrophotographic photosensitive member, generally, a high voltage (DC voltage of about 5 to 8 kilovolts) is applied to a metal wire to generate a corona, which is used for charging the photosensitive member. In this method, corona discharge products such as ozone and $NO_x$ are generated along with the generation of the corona. These corona discharge products deteriorate the surface of the photosensitive member thereby causing image quality deterioration such as image blur or image fading. Further, because the contamination on metal wire affects the image quality, there has been problems such as white droppings, dropouts or black streaks in the resultant copied image. In addition, the corona wire requires regular maintenance and cleaning.

Moreover, as most of the current flows to a shield plate disposed around the metal corona wire, the proportion of current directed to the photosensitive member is generally 5–30% of the consumed current. As a result, the conventional corona charging method has a low electrical power efficiency.

An alternative to the corona discharge wire is a contact-type charging device. Contact chargers have the advantage of reduced voltage requirements as well as reduced amounts of generated ozone. In contact chargers, a charging member, to which voltage is applied, is brought into contact with the surface of a member to be charged so as to charge the member.

These contact chargers have a multi-layer construction including a resilient layer about a rigid conducting shaft, a resistive layer formed on the resilient layer, and a third outer layer on the resistive layer to provide the necessary contact characteristics. The inner resilient conductive layer includes electrically conductive particles such a carbon black, graphite and metallic powder dispersed in an elastic material, such as rubber or resin to provide an electrical conductivity (resistivity). The resistive layer ensures an appropriate surface electrical resistance and the inner resistance layer retains appropriate elasticity and resistivity (conductivity) to provide an optimal nip width with respect to the surface of the member to be charged.

Sufficient elasticity is necessary to charge the member, such as a photosensitive drum, and to prevent leakage caused by pinholes in and damage to the surface of the photosensitive member. The resistive layer also includes dispersed electrically conductive particles which tend to become unstable and may vary from portion to portion of the layer.

Alternatively, an electrically conductive rubber roller may be formed by adding a silica type filler, carbon black, a foaming agent, a plasticizing additive, a vulcanizing agent and the like to a rubbery siloxane polymer, subjecting it to transfer forming, injection molding, performing, extrusion molding and the like, whereby it is cross-linked and made into roller form. These and similar charging members are disclosed in U.S. Pat. Nos. 5,313,359; 5,241,343; 5,126,913; 5,402,213; 5,443,873; and 5,017,965, herein incorporated by reference.

However, these prior designs are unable to provide repeated or multiple cycles for a given cartridge. That is, the alignment of the carbon or conductive fibers in the conductive elastomeric layer may deteriorate with use, thereby providing a nonuniform charge distribution in this layer. Further, upon the wearing of the outer resistive layer, any residual "hot spots" in the underlying resilient layer are exposed to the photosensitive member. Therefore, the need exists for a contact charger having a more nearly uniform charge distribution throughout the contact surface and any underlying surface. The need further exists for a contact charger which can be readily formed having sufficient tolerances to reduce deterioration of the printing quality through repeated cycles.

SUMMARY OF THE INVENTION

The present invention provides a contact charger having an increased operational life and reduced maintenance and cleaning requirements. The present contact charger includes a resilient layer formed by co-curing a rubber, a co-polymer and a poly(trans-octene) coupling agent. More particularly, the resilient layer may include co-cured polychloroprene and a co-polymer of epichlorohydrin and ethylene oxide electrically connected to a substrate. An outer nonstick layer is disposed about the inner layer to reduce adhesion of the surface and increase moisture stability. The use of only an inner and outer layer reduces production costs. While additional layers may be employed, such layers are not required for proper functioning.

DESCRIPTION OF THE PREFERRED EMBODIMENTS

Figure 1:
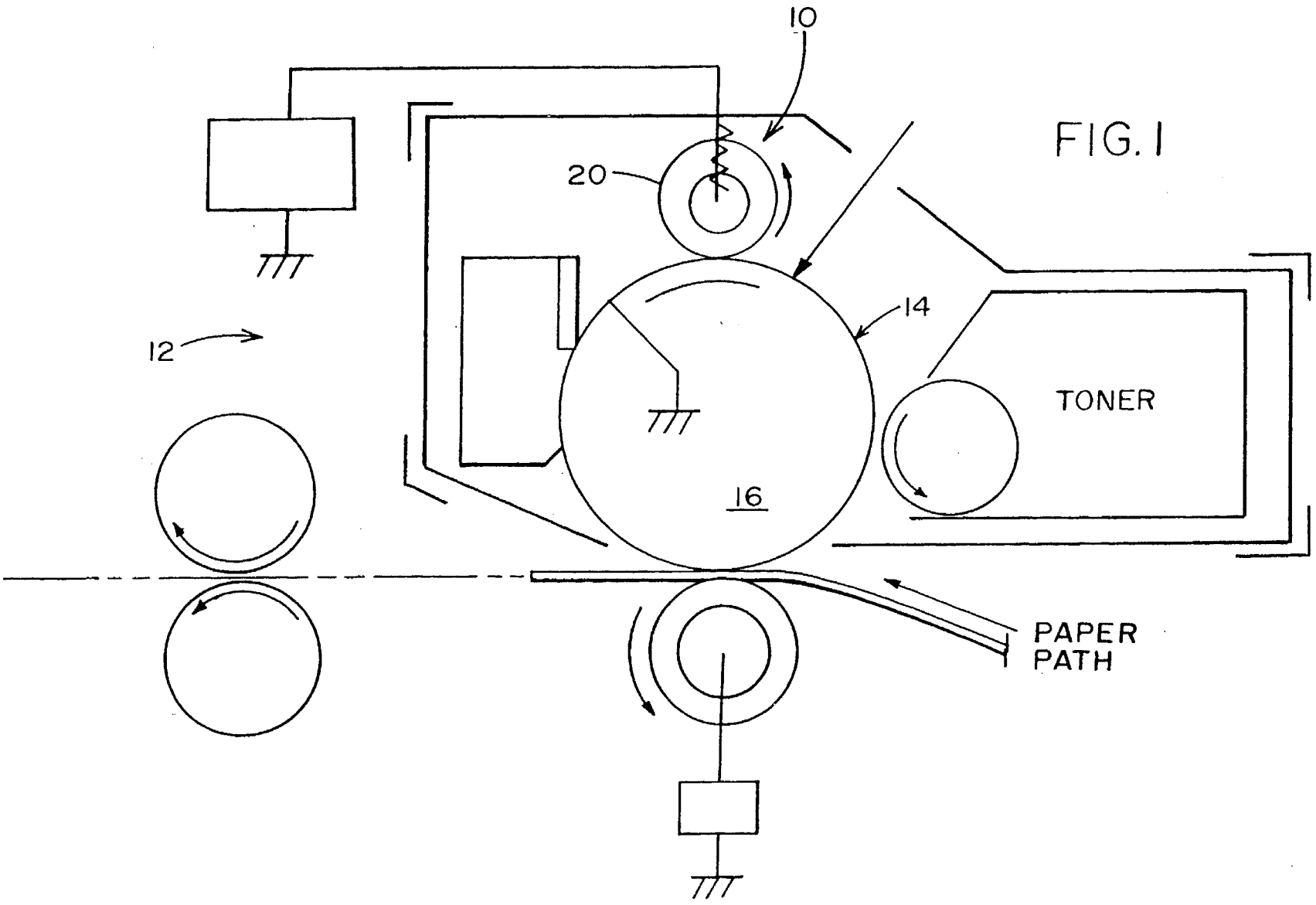
FIG. 1, is a schematic view of an operating environment with a configuration of the present contact charger.

Referring to FIG. 1, the present contact charger 10 may be in the form of a charge roller 20 and employed in a electrophotographic device 12. In the schematic view of FIG. 1, the electrophotographic printer 12 uses a charging device according to the present invention for charging an image bearing member 14. An electrophotographic sensitive member 14 in the form of a photosensitive drum (drum) 16 is employed as an image bearing member or a member to be charged. In this embodiment, the photosensitive drum comprises an OPC (organic photo conductor) photosensitive drum having a diameter of 30 mm which is driven to be rotated in the direction of arrow "a" at a certain peripheral speed (process speed). The basic operation of a photoelectric apparatus is described in U.S. Pat. No. 5,235,386, herein incorporated by reference.

Figure 2:
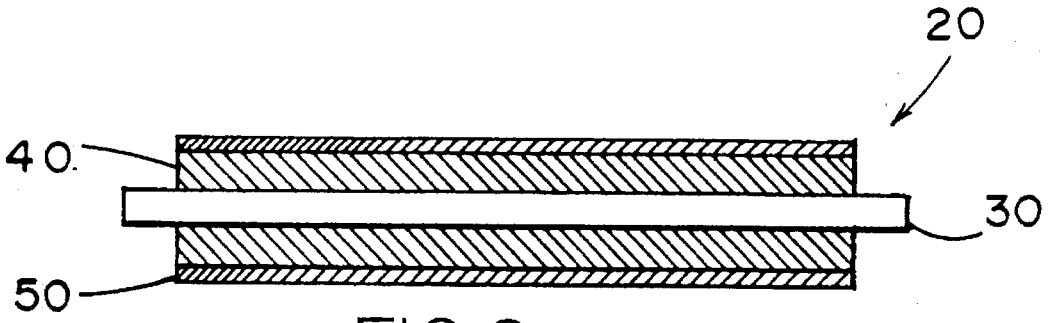
FIG. 2 is a cross sectional view of a contact charger in the form of a charge roller.
Figure 3:
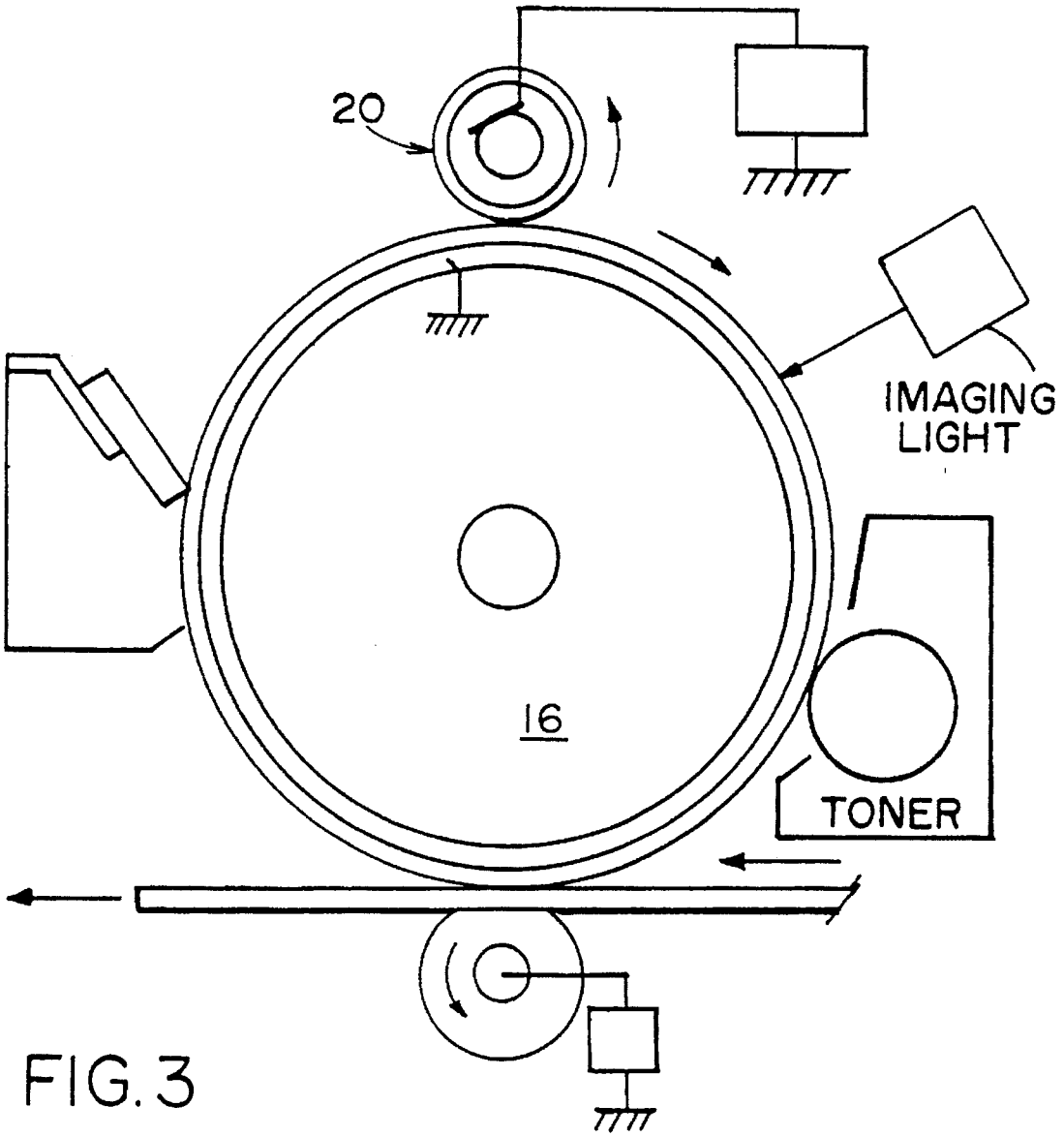
FIG. 3 is an alternative operating environment for the contact charger.

The contact charger 10 according to the present invention is shown as a charge roller 20. However, it is understood the contact charger 10 may be in the form of a plate, belt or other configuration. As shown in FIG. 2, the charge roller 20 has a diameter between 0.468 and 0.463 inches. The charge roller 20 is press contacted to the photosensitive drum 16 with a total pressing force of 9.8N (Newton) by means of a pressing spring and is rotated as a follower roller in accordance with the rotation of the photosensitive drum. A structure for urging a charge roller 20 against a photosensitive drum is disclosed in U.S. Pat. No. 5,367,364, herein incorporated by reference.

The charge roller 20 includes at least two layers 40, 50 formed on an electrically conductive substrate 30. Although the contact charger 20 may employ additional layers, the present device provides improved characteristics with only the two layer construction described herein. The substrate 30 may be any substance having an electrical conductivity and strength sufficient to support the contact charger 10 in the operable environment. Preferably, the substrate 30 is formed of stainless steel, iron, aluminum, electrically conductive plastic or similar material. The substrate 30 may be formed into a variety of shapes, such as a cylinder, a roll, a blade, a block, a rod, or a belt.

The first inner or base layer 40 is available from Advance Polymer Technologies, Spencerport, N.Y. The inner layer 40 is "DF-50 Neo-Antistat", a black, nonmarking, nonstaining polychloroprene formulated with a conductive polymer, poly{oxy(chloromethyl)ethylene-co-oxyethylene} ("ECO"), that becomes part of the polymer matrix upon curing. The material of the layer 40 is further formulated to have good mechanical properties for the roller material (approximately a 40 durometer shore) with good abrasion resistance and good compression set resistance. Further, the material is conductive to static electricity in the $10^6$ to $10^9$ ohms/cm range. The service temperature for this material is up to 200° F. for continuous use and 250° F. for intermittent use. The manufacturer has stated the material is a co-cured homogeneous mixture of ECO and polychloroprene, wherein the ECO provides the desired electrical conductivity (resistivity) of the inner layer. The material includes processing agents, plasticizers and vulcanizers known in such rubber forming industry, as well as a coupling agent to promote the co-curing of the ECO and polychloroprene. The homogeneous nature of the matrix with the cross linking of the ECO and the polychloroprene reduces the traditional "hot spots" associated with such layers. The cross linking reduces the component migration which can occur in prior art devices that rely upon carbon black for conductivity. Further, the cross linking and homogeneous structure provides increased life of the material prior to breakdown or detrimental flux in the resistivity of the material.

The inner layer 40 is therefore an electroconductive elastic (or elastomeric) layer which has been caused to have a predetermined conductivity (resistivity). The inner layer has the function of imparting an appropriate softness to the charge roller 20 so that the charge roller may be contacted to the photosensitive drum 16 to provide a uniform nip with respect to the respective portions thereof along the longitudinal dimension of the charge roller.

The second outer layer 50, as shown in FIG. 2 (not to scale), is an organosilane ester in an ethanolic solution sold as IR-38, IR-30 and IR-25 by Coatings for Industry, Inc., Souderton, Pa. The chemical name is N-beta-(aminoethyl)-gamma-aminopropyltrimethoxysilane and ethanol mixture. The outer layer 50 reduces the adhesive characteristics of the inner layer 40, without having to perform the resistivity function of reducing "hot spots" in the inner layer, and has a thickness less than approximately 0.001 inch. The organosilane ester may be in an ethanol, such as pure or denatured ethanolic solution, which may be diluted with water to account for humidity conditions. Alternatively, the outer layer 50 may include a heat shrink tube such as a Thermo-fit™ manufactured by Raychem. The shrink tube may be polyethylene or Teflon™ and provides a nonstick, reduced adhesive layer over the inner layer 40. The outer layer 50 also reduces exposure of the inner layer 40 to moisture and thereby renders the contact charger 10 more stable with respect to variations in humidity. The outer layer 50 reduces the tendency of the toner or developer material to stick to the contact charger.

The outer layer 50 merely reduces the adhesive tendencies of the inner layer 40 and provides a barrier to moisture penetration. The outer layer 50 does not perform and need not be constructed to provide a resistivity to minimize nonuniformities in the conductivity density of the inner layer 40. The outer layer 50 provides the necessary tackiness or adhesion characteristics of the contact charger 10 as dictated by the specific application. The outer layer 50 reduces the adhesion or tackiness of the inner layer 40, but the resultant characteristic is dictated by the anticipated application or use of the contact charger. That is, the outer layer 50 merely has a lesser tackiness than the inner layer 40. The degree of reduced adhesion below the inner layer 40 is dictated by the intended use.

FORMULATION

The electrostatic inner layer 40 according to the invention comprises a homogeneous crosslinked mixture of a rubber compound, a co-polymer, and a coupling agent as described below. Other materials in the mixture consist of several fillers, plasticizers and accelerators, which are well known in the prior art.

Preferably, the rubber compound is polychloroprene, available under the tradename Neoprene WHV from DuPont. The co-polymer is preferably poly[oxy(chloromethyl)ethylene-co-oxyethylene], or "ECO", which exhibits conductive characteristics. The equimolar co-polymer of epichlorohydrin and ethylene oxide is commercially available under the tradename Hydrin 2000 from Zeon Chemicals. Preferably, the polychloroprene content may be in the approximate range of 30–50 wt. % while the Hydrin 2000 content may be in the approximate range of 10–30 wt. % based on the weight of the polymer. A coupling agent, preferably poly(trans-octene), commercially available under the tradename Vestanemer from Hüls-America, is added to the mixture, preferably in an approximate range of 5–15 wt. %, to promote the co-curing of the two aforementioned compounds into a homogeneous matrix.

A catalyst or accelerator promoting the formation of the desired compound can be added to the material to be used for forming the conductive layer. Well known accelerators for the curing process in the field of polymer chemistry, available under the tradenames Tetron A from DuPont, TMTD from Vanderbilt, and MBT from Uniroyal Plastics, may preferably be added in the range 0.001 to 5 wt. % based on the weight of the polymer.

As for crosslinking agents, for example, sulfur type crosslinking agents may be employed. Preferably, the content of elemental sulfur may be in the range 0.001 to 5 wt.

% based on the weight of the polymer. The polymer is primarily crosslinked concurrently with molding using such molding methods as compression molding, injection molding or transfer molding or it is molded in roller form as by calendar roll molding, extrusion molding and primarily crosslinked by a known crosslinking method, such as HAV (hot air vulcanization).

Further, a plasticizer, preferably the plasticizer commercially available as TP90B from Morton International, is added in the range 5 to 25 wt. % to soften the polymer components and promote homogeneous blending. A lead curative, such as commercially available under the tradename DYPHOS from Synthetic Products, may be added in the range 0.001 to 5 wt. % to act as an acid acceptor in the curing process, thereby eliminating the degradation of the compound from any acid by-product.

Additional components of the inner layer 40 include a processing aid, preferably stearic acid, and an antioxidant/antiozanant, preferably commercially available under the tradename NBC from DuPont, which inhibits oxidation by free radicals. The content of the processing aid and antioxidant/antiozanant are preferably in the range of 0.001 to 5 wt. % based on the weight of the polymer.

A coloring agent, such as carbon black, is added to the mixture before curing to promote full pigmentation of the polymer. The preferable content of the coloring agent is in the range of 10–25 wt. % based on the weight of the polymer. The amount of carbon black added to the mixture is not sufficient to promote conductivity. All elastomers, including polychloroprene, are compounded with reinforcing agents such as carbon black to increase the color and strength properties of the final crosslinked product.

As for bulking fillers, mention may be made of inorganic fillers, such as reinforcing fillers, calcium carbonate, dixie clay, barium sulfate, talc, mica, asbestos, and graphite, and organic fillers, such as regenerated rubber, powder rubber, asphalt, and glue. The preferable content of the bulking filler may be in the range 0.001 to 5 wt. % based on the weight of the polymer.

The form or shape of the contact charger according to the present invention may be any of roller, brush, blade, belt, etc. The form of the contact charger can appropriately be selected corresponding to the specifications and form of an electrophotographic apparatus using it. Among these, a roller form is preferred in view of uniformity in charging.

The mixture of rubber, ECO and other agents for processing are mixed by a roll kneader, banbury mixer, ball mill, sand grinder or a paint shaker for distribution.

The mixture is formed into slabs and cut to predetermined weights. The predetermined weight is set by the size of the contact charger to be formed. An elongate cylindrical mold is prepared with the substrate retained within the mold by end bushings. The substrate 30 may be surface treated by sand blasting to create a sufficient surface texture to enhance bonding of the material to the substrate. The material is then introduced into the mold by transfer molding. Transfer molding is disclosed in U.S. Pat. No. 5,270,768, herein incorporated by reference.

The mixture is cured in the mold by an appropriate setting of the parameters of the time (dwell), temperature and pressure. For the present molds, the blend including polychloroprene and ECO is co-cured for approximately 15 minutes at a temperature of approximately 330° F. and a pressure of 2 atmospheres. These parameters are of course determined by the specific molds and the amount of material to be cured.

Figure 4:
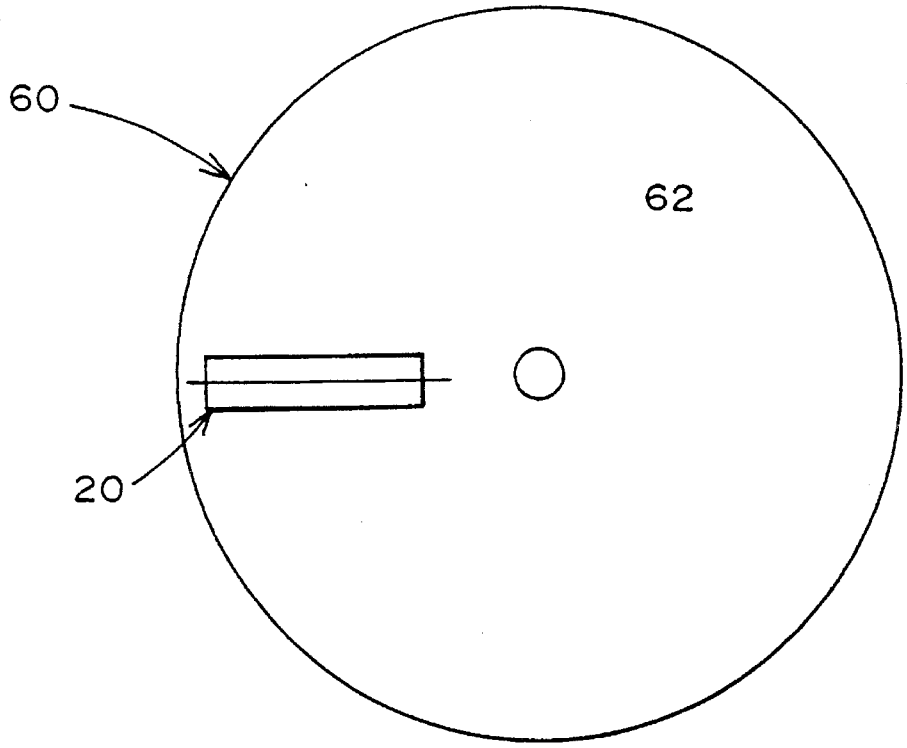
FIG. 4 is a schematic view showing the grinding of a contact charger.
Figure 5:
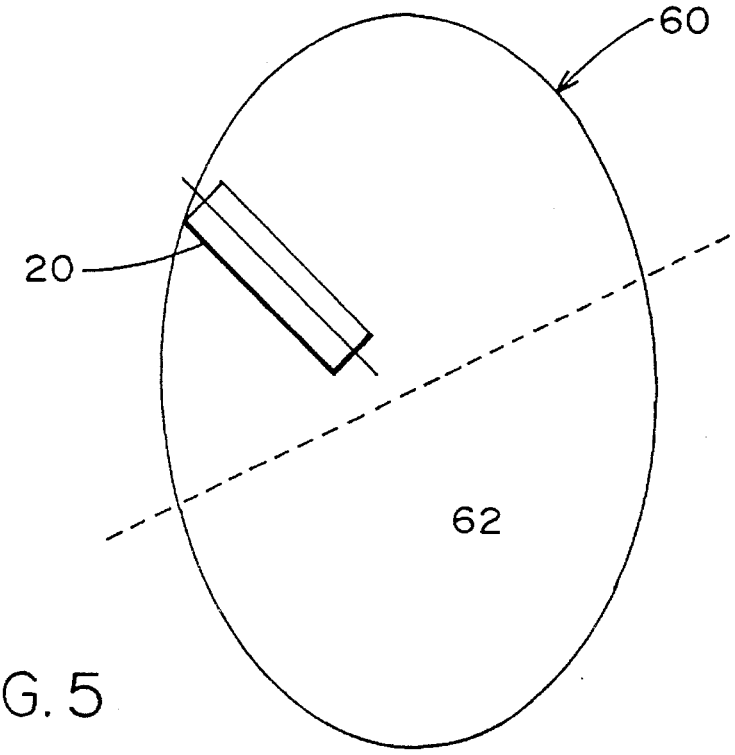
FIG. 5 is a perspective schematic showing the grinding of a contact charger.

The set body with substrate 30 is removed and may be form finished by kiss grinding on a commercially available grinder 60 under the tradename "Time Saver", as shown in FIGS. 4 and 5. Kiss grinding employs a large rotating abrasive element, wherein a working surface 62 of the abrasive element is perpendicular to the axis of rotation. The rollers are brought into contact with the working surface such that the longitudinal axis of the rollers are perpendicular to the axis of rotation of the grinder so that the rotation of the grinder 60 causes rotation of the roller about its longitudinal axis. The grinding thereby removes a slight amount of material such as gate, parting lines or feed lines.

The kiss grinding produces a roughened or patterned surface on the inner layer 40. The inner layer surface has a cross hatched or diamond appearance. The ground surface allows for an even distribution of the outer layer 50. The grinding also produces a more consistent nip for enhanced charging and erasing by the contact charger 10.

The adhesion resistant or nonstick coating is applied by dip processing or a swab type application of the organosilane ester in an ethanolic solution. Preferably, the solution is denatured ethanol containing approximately 60% ethanol and 6% isopropanol by weight. The addition of water, on the order of a few drops per ounce, to the ethanol solution is determined by the humidity during the application process. It has been found that more water is necessary in relatively lower humidity ranges with less water necessary in relatively high humidity conditions.

Alternatively, the shrink wrap may be applied to the homogeneous body and subsequently heated to conform to the body shape.

The finished contact charger is scanned by computer to measure the resistivity. For the application as a charge roller in laser printers, the desired resistivity falls within the range of $10^{-7}$ to $10^{-9}$ ohms/cm within the desired durometer limit of approximately 40.

It has been found that only ethanol is necessary to clean the present construction. In fact, use of other cleaning agents or solvents may damage the outer layer or migrate to the inner layer and damage the material.

The homogeneous structure of the cross linked ECO and polychloroprene in the inner layer 40 provides a substantially uniform conductivity (resistivity) density in the material and therefore, upon wear or repeated use, the material retains the uniform distribution without generating hot spots by component migration in the inner layer. While previous structures can be subject to degraded performance levels after only a single cycle, the present construction has been tested to over 10 cycles with only an ethanol wipe cleaning between cycles. The crosslinking of the conductive ECO with the rubber substantially reduces migration of the individual components during use, and therefore provides for increased useful life. It is believed the present design can provide OEM results up to 18 cycles, so long as the outer layer remains intact.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

We claim:

1. A contact charger for charging a secondary device by contact, comprising:

(a) an electrically conductive substrate;

(b) a resilient conductive layer including a crosslinked blend of polychloroprene, poly[oxy(chloromethyl)ethylene-co-oxyethylene] and poly(transoctene); and (c) an outer layer overlying the conductive layer and having lower adhesion than the inner layer.

2. A contact charger for charging a secondary device by contact, comprising:

(a) an electrically conductive substrate;

(b) a resilient conductive layer including a crosslinked blend of rubber, a conductive co-polymer and a coupling agent; and (c) a nonstick layer overlying the conductive layer.

3. The contact charger of claim 2, wherein the coupling agent includes poly(transoctene).

4. The contact charger of claim 2, wherein the rubber includes polychloroprene.

5. The contact charger of claim 2, wherein the resilient conductive layer includes a cross linked matrix including polychloroprene, and a co-polymer of epichlorohydrin and ethylene oxide.

6. The contact charger of claim 2, wherein the nonstick layer includes a polysiloxane coating.

7. The contact charger of claim 2, wherein the nonstick layer includes one of Teflon, polyethylene, and organosilane ester with ethanol.

8. The contact charger of claim 2, wherein the conductive substrate is a metallic shaft.

9. The contact charger of claim 2, wherein the conductive substrate is a stainless steel shaft.

10. The contact charger of claim 2, wherein the resilient conductive layer includes an amount of carbon black sufficient to color the layer.

11. A contact charger, comprising a resilient conductive layer formed by co-curing a blend of polychloroprene and a co-polymer of epichlorohydrin and ethylene oxide.

12. The contact charger of claim 11, further comprising an electrically conductive substrate electrically connected to the conductive layer.

13. The contact charger of claim 11, further comprising a nonstick layer overlying the conductive layer.

14. A process cartridge detachably mounted to an image forming apparatus, the process cartridge, comprising:

(a) a movable image bearing member; and (b) a charging member contactable to the image bearing member, wherein the charging member includes a co-cured blend of rubber, a conductive copolymer and a polyalkene coupling agent.

15. A contact charger for charging a secondary device by contact, comprising:

(a) an electrically conductive substrate;

(b) a resilient conductive layer formed by co-curing a rubber, a conductive copolymer and a coupling agent, the coupling agent promoting the co curing of the rubber and the conductive copolymer; and (c) a nonstick layer overlying the conductive layer.

16. The contact charger of claim 15, wherein the electrically conductive substrate is a metallic shaft.

17. The contact charger of claim 15, wherein the rubber is polychloroprene.

18. The contact charger of claim 15, wherein the coupling agent is poly-transoctene.

19. The contact charger of claim 15, wherein the nonstick layer includes one of Teflon, polyethylene and an organosilane ester with ethanol.

20. The contact charger of claim 15, wherein the conductive copolymer is an equimolar copolymer of epichlorohydrin and ethylene oxide.

21. A method of forming a contact charger, comprising:

(a) electrically contacting a resilient conductive layer including a crosslinked blend of rubber, a conductive co-polymer and a coupling agent to an electrically conductive substrate; and (b) disposing a reduced adhesion coating on a portion of the resilient conductive layer.

22. The method of claim 21, further comprising cross linking a blend polychloroprene, a conductive co-polymer of epichlorohydrin and ethylene oxide and poly(transoctene).

23. The method of claim 21, further comprising surface finishing the conductive layer to impart a roughened texture.

24. The method of claim 23, further comprising disposing the reduced adhesion coating on the roughened texture.

* * * * *